United States Patent [19]

Chin

[11] Patent Number: 5,021,146

[45] **Date of Patent: * Jun. 4, 1991**

[54] REDUCING $NO_x$ EMISSIONS WITH GROUP IIIB COMPOUNDS

[75] Inventor: Arthur A. Chin, Cherry Hill, N.J.

[73] Assignee: Mobil Oil Corporation, Fairfax, Va.

[ * ] Notice: The portion of the term of this patent subsequent to May 1, 2007 has been disclaimed.

[21] Appl. No.: 458,004

[22] Filed: Dec. 28, 1989

[51] Int. Cl.[5] ..... C10G 11/18

[52] U.S. Cl. ..... 208/122; 208/113; 208/52 CT; 208/149; 423/239

[58] Field of Search ..... 208/113, 121, 89, 52 CT, 208/149, 122; 502/424

[56] References Cited

U.S. PATENT DOCUMENTS

| | | | |
|---|---|---|---|
| 3,545,917 | 12/1970 | Stephens | 502/303 |
| 3,880,982 | 4/1975 | Stenzel | 423/239 |
| 3,897,367 | 7/1975 | Lauder | 423/213.5 |
| 4,085,193 | 4/1978 | Nakajima et al. | 423/239 |
| 4,187,199 | 2/1980 | Csicsery | 502/65 |
| 4,235,704 | 11/1980 | Luckenbach | 208/113 |
| 4,303,625 | 12/1981 | Cull | 423/239 |
| 4,432,890 | 2/1984 | Beck et al. | 502/62 |
| 4,521,389 | 6/1985 | Blanton et al. | 208/113 |
| 4,589,978 | 5/1986 | Green et al. | 208/113 |
| 4,847,054 | 7/1989 | Weisweiler | 423/239 |

*Primary Examiner*—Anthony McFarlane

*Attorney, Agent, or Firm*—A. J. McKillop; C. J. Speciale; Richard D. Stone

[57] ABSTRACT

A process for regeneration of cracking catalyst while minimizing $NO_x$ emissions is disclosed. A Group IIIB based $DeNO_x$ additive is present in an amount and in a form which reduces $NO_x$ emissions. Relatively small amounts of lanthanum or yttrium oxides, or lanthanum titanate, preferably impregnated on a separate support are effective to reduce $NO_x$ produced in the regenerator. The additive converts $NO_x$ to nitrogen even when Pt CO combustion promoter and some excess oxygen are present in the regenerator.

20 Claims, No Drawings

REDUCING $NO_x$ EMISSIONS WITH GROUP IIIB COMPOUNDS

BACKGROUND OF THE INVENTION

1. Field of the Invention

The field of the invention is catalytic cracking of heavy hydrocarbon feeds.

2 Description of Related Art

Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425C.-600C., usually 460C.-560C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off, restoring catalyst activity and simultaneously heating the catalyst to, e.g., 500C.-900C., usually 600C.-750C. Flue gas formed by burning coke in the regenerator may be treated for removal of particulates and for conversion of carbon monoxide, after which the flue gas is normally discharged into the atmosphere.

Most FCC units now use zeolite-containing catalyst having high activity and selectivity. These catalysts work best when the amount of coke on the catalyst after regeneration is relatively low. It is desirable to regenerate zeolite catalysts to as low a residual carbon level as is possible. It is also desirable to burn CO completely within the catalyst regenerator system to conserve heat and to minimize air pollution. Heat conservation is especially important when the concentration of coke on the spent catalyst is relatively low as a result of high catalyst selectivity. Among the ways suggested to decrease the amount of carbon on regenerated catalyst and to burn CO in the regenerator is to add a CO combustion promoter metal to the catalyst or to the regenerator. Metals have been added as an integral component of the cracking catalyst and as a component or a discrete particulate additive, in which the active metal is associated with a support other than the catalyst. U.S. Pat. No. 2,647,860 proposed adding 0.1 to 1 weight percent chromic oxide to a cracking catalyst to promote combustion of CO. U.S Pat. No. 3,808,121, incorporated herein by reference, introduced relatively large-sized particles containing CO combustion-promoting metal into a cracking catalyst regenerator. The circulating particulate solids inventory, of small-sized catalyst particles, cycled between the cracking reactor and the catalyst regenerator, while the combustion-promoting particles remain in the regenerator. Oxidation-promoting metals such as cobalt, copper, nickel, manganese, copper-chromite, etc., impregnated on an inorganic oxide such as alumina, are disclosed.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory.

Many FCC units use CO combustion promoters. This reduces CO emissions, but usually increases nitrogen oxides ($NO_x$) in the regenerator flue gas. It is difficult in a catalyst regenerator to completely burn coke and CO in the regenerator without increasing the $NO_x$ content of the regenerator flue gas.

$SO_x$ emissions are also a problem in many FCC regenerators. $SO_x$ emissions can be greatly reduced by including $SO_x$ capture additives in the catalyst inventory, and operating the unit at relatively high temperature, in a relatively oxidizing atmosphere. In such conditions, the $SO_x$ additive can adsorb or react with $SO_x$ in the oxidizing atmosphere of the regenerator, and release the sulfur as H2S in the reducing atmosphere of the cracking reactor. Platinum is known to be useful both for creating an oxidizing atmosphere in the regenerator via complete CO combustion and for promoting the oxidative adsorption of SO2. Hirschberg and Bertolacini reported on the catalytic effect of 2 and 100 ppm platinum in promoting removal of SO2 on alumina. Alumina promoted with platinum is more efficient at SO2 removal than pure alumina without any platinum. Unfortunately, those conditions which make for effective $SO_x$ removal (high temperatures, excess $O_2$, Pt for CO combustion or for $SO_x$ adsorption) all tend to increase $NO_x$ emissions.

Many refiners have recognized the problem of $NO_x$ emissions from FCC regenerators, but the solutions proposed so far have not been completely satisfactory. Special catalysts have been suggested which hinder the formation of $NO_x$ in the FCC regenerator, or perhaps reduce the effectiveness of the CO combustion promoter used. Process changes have been suggested which reduce $NO_x$ emissions from the regenerator.

Recent catalyst patents include U.S. Pat. No. 4,300,997 and its division U.S. Pat. No. 4,350,615, both directed to the use of Pd-Ru CO-combustion promoter. The bi-metallic CO combustion promoter is reported to do an adequate job of converting CO to $CO_2$, while minimizing the formation of $NO_x$.

Another catalyst development is disclosed in U.S. Pat. No. 4,199,435 which suggests steam treating conventional metallic CO combustion promoter to decrease $NO_x$ formation without impairing too much the CO combustion activity of the promoter.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas. As an alternative to adding less CO combustion promoter the patentee suggests deactivating it in place, by adding something to deactivate the Pt, such as lead, antimony, arsenic, tin or bismuth.

Process modifications are suggested in U.S. Pat. No. 4,413,573 and U.S. Pat. No. 4,325,833 directed to two- and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

The approach taken in U.S. Pat. No. 4,542,114 is to minimize the volume of flue gas by using oxygen rather than air in the FCC regenerator, with consequent reduction in the amount of flue gas produced.

All the catalyst and process patents discussed above from U.S. Pat. No. 4,300,997 to U.S. Pat. No. 4,542,114, are incorporated herein by reference.

In addition to the above patents, there are myriad patents on treatment of flue gases containing $NO_x$. The flue gas might originate from FCC units, or other units. U.S. Pat. Nos. 4,521,389 and 4,434,147 disclose adding NH3 to $NO_x$ containing flue gas to catalytically reduce the $NO_x$ to nitrogen.

None of the approaches described above provides the perfect solution. Process approaches, such as multistage or countercurrent regenerators, reduce $NO_x$ emissions but require extensive rebuilding of the FCC regenerator.

Various catalytic approaches, e.g., use of bi-metallic CO combustion promoters, steamed combustion promoters, etc., to degrade the efficiency of the Pt function help some but still may fail to meet the ever more stringent $NO_x$ emissions limits set by local governing bodies.

I discovered that Group IIIB compounds, preferably oxides, and especially lanthanum oxides, added in a special way to the inventory of a catalytic cracking unit, could reduce $NO_x$ emissions in the flue gas from the regenerator.

This was surprising, because these materials had never been reported to be effective catalysts for reducing $NO_x$ emissions in an FCC regenerator. Lanthanum, usually mixed with other rare earth elements, is a common ingredient in cracking catalysts, especially in zeolite-based cracking catalysts. Lanthanum has also been suggested for use as a CO combustion promoter, for use in $SO_x$ capture additives, and proposed as a metals passivator. Each of these uses of lanthanum will be briefly reviewed.

Rare earth stabilization of zeolites is well known. Studies have also been made on individual species, such as lanthanum and cerium, and on the relative merits of incorporating the rare earths by ion exchange into a zeolite as compared to impregnation onto a matrix holding the zeolite.

Lanthanum was proposed as a metals passivator, in U.S. Pat. No. 4,432,890, which is incorporated herein by reference. The metal was added to the catalyst during manufacture, or a metal compound would be added to some point of the unit, e.g., a soluble organometallic compound would be added to the feed.

U.S. Pat. No. 4,187,199, to Csicsery et al, which is incorporated herein by reference, disclosed lanthanum or a lanthanum compound in association with a porous inorganic oxide as a CO combustion promoter. The lanthanum was dispersed in the porous matrix.

U.S. Pat. No. 4,589,978, Green et al, which is incorporated herein by reference, disclosed a lanthanum containing catalyst for $SO_x$ removal from FCC regenerator flue gas. A $SO_x$ transfer catalyst was used which comprised cerium and/or lanthanum and alumina wherein cerium comprises at least about 1 wt %. The patentees impregnated gamma alumina with lanthanum chloride heptahydrate, then calcined for four hours in air at 538 C. The material contained 20 wt. % La on gamma alumina. Silica supported (Hysil 233) lanthanum materials were also prepared. Both the silica supported and the alumina supported lanthanum materials were effective at $SO_x$ uptake. The lanthanum on silica material was more than 10 times slower at releasing H2S than the cerium on silica. The lanthanum sulfate species on silica was reported to be virtually irreducible. The effect of these materials on $NO_x$ emissions was not reported.

The use of various rare earth oxides for the catalytic reduction of NO with CO at 200–475 C. (392–887 F.) was studied by Peters, M. S. and Wu, J. L., in Atmospheric Environment, 11,459–463, 1977. At these temperatures, CeO2 was the only rare earth to show substantial NO conversion.

I discovered a way to reduce $NO_x$ emissions from an FCC regenerator, especially from an FCC regenerator operating in complete combustion mode with a CO combustion promoter such as Pt, by adding a Group IIIB based additive in a special form. My method of addition reduces $NO_x$ emissions in a way that could not have been predicted from a review of all the prior work on adding lanthanum. I also discovered an especially effective form of the additive, which permits effective reduction of $NO_x$ emissions, without excessive dilution of the cracking catalyst. My invention permits efficient operation of $SO_x$ capture additives containing platinum, while minimizing $NO_x$ emissions.

BRIEF SUMMARY OF THE INVENTION

Accordingly, the present invention provides in a process for the catalytic cracking of a heavy hydrocarbon feed containing nitrogen compounds by contact with a circulating inventory of catalytic cracking catalyst to produce catalytically cracked products and spent catalyst containing coke comprising nitrogen compounds, and wherein said spent catalyst is regenerated by contact with oxygen or an oxygen-containing gas in a catalyst regeneration zone operating at catalyst regeneration conditions to produce hot regenerated catalyst which is recycled to catalytically crack the heavy feed and said catalyst regeneration zone produces a flue gas comprising CO, $CO_2$ and oxides of nitrogen ($NO_x$), the improvement comprising reducing the $NO_x$ content of the flue gas by adding to the circulating catalyst inventory an additive comprising discrete particles comprising oxides of Group IIIB elements, exclusive of Group III elements which may be ion exchanged or impregnated into said cracking catalyst, said additive being added in an amount sufficient to reduce the production of $NO_x$ relative to operation without said additive.

In another embodiment, the present invention provides in a process for the catalytic cracking of a hydrotreated, thermally treated, or distilled heavy hydrocarbon feed containing more than 500 ppm N by contact with a circulating inventory of catalytic cracking catalyst wherein said feed is cracked by contact with a source of hot regenerated cracking catalyst to produce catalytically cracked products and spent catalyst containing coke comprising nitrogen compounds, and wherein said spent catalyst is regenerated by contact with oxygen or an oxygen-containing gas is a catalyst regeneration zone operating at catalyst regeneration conditions including the presence of excess oxygen or oxygen-containing gas to produce hot regenerated catalyst which is recycled to catalytically crack the heavy feed and said catalyst regeneration zone produces a flue gas comprising CO, $CO_2$ and oxides of nitrogen ($NO_x$) the improvement comprising adding to the circulating catalyst inventory an additive comprising discrete particles comprising oxides of Group IIIB elements, exclusive of Group III elements which may be ion exchanged or impregnated into said cracking catalyst, in an amount sufficient to reduce the production of $NO_x$ in said flue gas by at least 20%.

In a more limited embodiment, the present invention provided a process for the catalytic cracking of a heavy hydrocarbon feed comprising more than 1000 wt ppm nitrogen by contacting the heavy feed with a circulating inventory of cracking catalyst comprising a zeolite containing cracking catalyst which catalyst inventory comprises 0.1 to 10 wt ppm Pt or other CO combustion promoting metal having an equivalent combustion activity said process comprising: cracking the heavy feed with said circulating inventory of catalytic cracking catalyst which contains from 0.5 to 5 wt % of an oxide of lanthanum or yttrium or mixtures thereof or lanthanum titanate, on an elemental metal basis, exclusive of lanthanum or yttrium which may be ion exchanged or impregnated into said cracking catalyst, in a catalytic cracking reaction zone means to produce cracked products and spent catalyst containing nitrogenous coke; separating and recovering from spent catalyst catalytically cracked products as a product of the process and a spent catalyst stream containing strippable cracked products; stripping the spent catalyst to remove strippable cracked products therefrom and produce stripped catalyst containing nitrogenous coke; regenerating the stripped catalyst by contact with an excess supply of oxygen or an oxygen-containing gas in a catalyst regeneration means to produce regenerated catalyst which is recycled to the catalytic cracking zone means to crack fresh feed and a flue gas containing CO, $CO_2$ $O_2$, $NO_x$, and wherein at least 90% of the CO is converted to $CO_2$ and at least 25% of the $NO_x$ is catalytically converted in the regeneration zones means to nitrogen by said oxide of lanthanum, yttrium, or mixtures thereof or lanthanum titanate.

DETAILED DESCRIPTION

The present invention is an improvement for use in any catalytic cracking unit which regenerates cracking catalyst. The invention will be most useful in conjunction with the conventional all riser cracking FCC units, such as disclosed in U.S. Pat. No. 4,421,636, which is incorporated herein by reference.

Although the present invention is applicable to both moving bed and fluidized bed catalytic cracking units, the discussion that follows is directed to FCC units which are considered the state of the art.

FCC FEED

Any conventional FCC feed can be used. The process of the present invention is useful for processing nitrogenous charge stocks, those containing more than 500 ppm total nitrogen compounds, and especially useful in processing stocks containing very high levels of nitrogen compounds, such as those with more than 1000 wt ppm total nitrogen compounds. There are many high nitrogen, low sulfur and low metal feeds which cause $NO_x$ emission problems even though sulfur emissions are not a problem, and metals passivation is not necessary. There are many crudes like this, such as Nigerian gas oils containing more than 1000 ppm N, but less than 0.3 wt % S.

The feeds may range from the typical, such as Nigerian discussed above, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

Hydrotreated feeds, with high residual nitrogen contents, are ideal for use in the process of the present invention. Hydrotreating efficiently removes sulfur and metals from heavy hydrocarbon feeds, but does not remove nitrogen compounds as efficiently. For these hydrotreated gas oils, vacuum gas oils, etc., there is a need for a cost effective method of dealing with $NO_x$ emissions which would allow the units to be pushed to the maximum extent possible. The hydrotreated feeds are readily crackable, and high conversions and coke and gasoline yields can be achieved. However, if $NO_x$ emissions from the regenerator are excessively high the flexibility and severity of FCC operations can be severely limited.

The process of the present inventional will be also be useful when the feed has been subjected to a preliminary thermal treatment, to remove metal and Conradson Carbon Residue material. Thus the feeds contemplated for use herein include those which have been subjected to a "thermal visbreaking" or fluid coking treatment, such as that treatment disclosed in U.S. Pat. No. 4,822,761. The products of such a treatment process would have relatively low levels of metal, similar to metals levels of hydrotreated feed, but would still have a relatively high nitrogen content.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites such as X and Y zeolites, or aluminum deficient forms of these zeolites such as dealuminized Y (DEAL Y), ultrastable Y (USY) and ultrahydrophobic Y (UHP Y) zeolites may be used. The zeolites may be stabilized with Rare Earths, e.g., 0.1 to 10 wt % RE.

Relatively high silica zeolite containing catalysts are preferred for use in the present invention. They withstand the high temperatures usually associated with complete combustion of CO to $CO_2$ within the FCC regenerator. Catalysts containing 10–40% USY or rare earth USY (REUSY) are especially preferred. The rare earths which are ion exchanged with the X or Y zeolite are not believed to be effective at reducing $NO_x$ emissions, and any rare earth content associated with the zeolite or the matrix containing the zeolite is ignored for purposes of calculating how much Group IIIB additive, e.g., lanthanum additive is present.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure).

CO combustion additives are available from most FCC catalyst vendors.

The FCC catalyst composition, per se, forms no part of the present invention.

$SO_x$ ADDITIVES

Additives may be used to adsorb $SO_x$. These are believed to be primarily various forms of alumina, containing minor amounts of Pt, on the order of 0.1 to 2 ppm Pt.

It is believed that some commercial $SO_x$ additives contain relatively large amounts of rare earths, e.g., 20 wt % rare earths. These additives are not believed to have any significant activity for $NO_x$ reduction.

Good additives for removal of $SO_x$ are available from several catalyst suppliers, such as Davison's "R" or Katalistiks International, Inc.'s "DESOX."

The cerium and/or lanthanum on alumina additive of U.S. Pat. No. 4,589,978, Green et al, may be used to reduce $SO_x$ emissions.

The process of the present invention works well with these additives, in that the effectiveness of the $SO_x$ additive is not impaired by adding my $DeNO_x$ additive. My $DeNO_x$ additive also works well at the conditions essential for proper functioning of the $SO_x$ additive, namely relatively high temperatures, excess oxygen in regenerator flue gas, and the presence of Pt promoter.

$NO_x$ ADDITIVE

The process of the present invention uses Group IIIB compounds, preferably Group IIIB oxides which are effective to reduce $NO_x$ emissions from FCC regenerators. Any Group IIIB compounds, or preferably oxides, can be used which are effective for reducing $NO_x$ emissions. Thus compounds or, preferably, oxides of Sc, Y, La or Ac, or mixtures thereof may be used herein. The oxides of Y and La are especially preferred, with La oxides giving the best results.

Although oxides are preferred, other Group IIIB compounds may be used, not necessarily with equivalent results.

The $NO_x$ additive may be used neat, but preferably it is disposed on a porous support which allows it to circulate freely with the conventional cracking catalyst. The desired $NO_x$ additive, or a precursor thereof, may be impregnated, precipitated, or physically admixed with a porous support, when it is desired to use the additive on a support.

The $NO_x$ additive can comprise 0.5 to 85 wt % Group IIIB oxide, on an elemental basis, and preferably from 1 to 20 wt % Group IIIB oxide and most preferably 2 to 15 wt % Group IIIB oxide, on an elemental Group IIIB element basis.

The $NO_x$ additive may also be present as a distinct phase within the conventional cracking catalyst particles. To accomplish this, a Group IIIB oxide on a support could be prepared, as described in U.S. Pat. No. 4,589,978 (Green et al) and the resulting product slurried with the dry ingredients used to form cracking catalyst.

Whether present as a distinct phase within the cracking catalyst, or present as a separate particle additive, the additive may comprise from 0.1 to 20 wt % of the equilibrium catalyst, and preferably comprises 0.2 to 10 wt %, and most preferably 0.5 to 5 wt % of the catalyst inventory.

The amount of additive present may also be adjusted based on the amount of nitrogen in the feed. When a La based additive is used, operation with 0.05 to 50 weights of La per weight of nitrogen in the feed will give good results. Preferably 0.1 to 20 and most preferably 0.5 to 10 weights of La are present in the circulating catalyst inventory per weight of feed nitrogen.

Rare earths which have been ion exchanged into an X or Y zeolite or impregnated onto cracking catalyst do not exhibit $NO_x$ conversion activity, and form no part of the present invention.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 5 seconds, and most preferably about 0.75 to 4 seconds, and riser top temperatures of 900 to about 1050 F.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

CATALYST REGENERATION

The process and apparatus of the present invention can use conventional FCC regenerators. The process of the present invention is especially effective when using somewhat unusual conditions in the regenerator, specifically, relatively complete CO combustion, but with very little excess air, preferably less than 1% $O_2$ being in the flue gas from the regenerator. Most FCC units operating with complete CO combustion operate with more oxygen than this in the flue gas, with many operating with 2 mole % $O_2$ in the flue gas.

Preferably a high efficiency regenerator is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention.

CO COMBUSTION PROMOTER

Use of a CO combustion promoter in the regenerator or combustion zone is not essential for the practice of the present invention, however, it is preferred. These materials are well-known.

U.S. Pat. Nos. 4,072,600 and 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

EXAMPLES

A series of laboratory micro unit tests were conducted to determine the effectiveness of my additive.

EXAMPLE 1

Prior Art

Example 1 is a base case or prior art case operating without any $NO_x$ reduction additive.

The catalyst was a sample of spent equilibrium FCC catalyst taken from a commercial FCC unit. Chemical and physical properties are reported in Table 1.

TABLE 1

| SPENT CATALYST PROPERTIES | |
|---|---|
| Surface Area, $m^2/g$ | 133 |
| Bulk Density, g/cc | 0.80 |
| Al203, wt % | 43.2 |
| Carbon, wt % | 0.782 |
| Nickel, ppm | 1870 |
| Vanadium, ppm | 1000 |
| Sodium, ppm | 3000 |
| Copper, ppm | 28 |
| Iron, ppm | 5700 |
| Platinum, ppm | 1.4 |
| Nitrogen, ppm | 160 |

A 10 g sample of this catalyst was placed in a laboratory fixed fluidized bed regenerator and regenerated at 1300 F. by passing 200 cc/min of a regeneration gas comprising 10% $O_2$ and 90% N2. $NO_x$ emissions in the resulting flue gas were determined via chemiluminescence, using an Antek 703C $NO_x$ detection system.

EXAMPLE 2

Invention

Example 1 was repeated, but this time 0.5 g of chemical grade lanthanum titanate (Alfa) was added to the 10 g sample of spent catalyst. The $DeNO_x$ activity was determined by comparing the integrated $NO_x$ signal to the base case without additive. The integrated $NO_x$ signal roughly corresponds to the average performance that would be expected in a commercial FCC unit, operating at steady state conditions. The integrated $NO_x$ was reduced 33%.

EXAMPLE 3

Invention

Example 1 was repeated with 0.5 g of La oxide (Fisher). The integrated $NO_x$ was reduced 21%.

EXAMPLE 4

Invention

Example 1 was repeated with 0.5 g of Y203 (Alfa). The integrated $NO_x$ was reduced 26%.

EXAMPLE 5

Comparison Test—Cerium

Example 1 was repeated with 0.5 g of CeO2 (Fisher). The integrated $NO_x$ was reduced 6%.

EXAMPLES 6-7

Comparison Test—Ti, Zr

Several other additives were tested in a similar fashion, and the experimental results reported in Table 2.

EXAMPLE 8

Invention

Example 2 was repeated, but this time the La2Ti2O7 was presteamed at 1400 F, 100% steam, 1 atm, for 5 hours. The integrated $NO_x$ was reduced 42%. The significance of Example 8 is that it shows my $DeNO_x$ additive is not deactivated by the steaming conditions found in typical FCC regenerators.

The experimental results are summarized in Table 2.

TABLE 2

| EXAMPLE | ADDITIVE | % REDUCTION IN $NO_x$ |
|---|---|---|
| 1 (base) | none | base |
| 2 | La2Ti2O7 | 33% |
| 3 | La2O3 | 21% |
| 4 | Y2O3 | 26% |
| 5 | CeO2 | 6% |
| 6 | TiO2 | 1% |
| 7 | ZrO2 | (+3%) |
| 8 | La2Ti2O7 (steamed) | 42% |

These experimental results show that Group IIIB compounds, especially lanthanum oxides and lanthanum titanate, in the form of separate particles, are effective at catalytically reducing the amount of $NO_x$ contained in FCC regenerator flue gas. My additive retains its activity upon steaming, which indicates that the additive will continue to function in the high temperature, steam laden environment of an FCC regenerator, and even improve as a result of steaming in the regenerator.

If practicing the invention now, I would add sufficient lanthanum titanate to the FCC catalyst, either as discrete particles within the FCC catalyst, or as a separate particle additive to achieve $NO_x$ reduction. The additive would be present in an amount equal to 0.5 to 5 wt % of the equilibrium catalyst, on an elemental lanthanum basis.

The process of the present invention will work well in regenerators operating at 1000 to 1650 F., preferably at 1150 to 1500 F., and most preferably at 1200 to 1400 F. $NO_x$ emissions will be reduced over a large range of excess air conditions, ranging from 0.1 to 5% $O_2$ in flue gas. Preferably the flue gas contains 0.2 to 4% $O_2$, and most preferably 0.5 to 2% $O_2$, with especially low $NO_x$ emissions being achieved when the flue gas contains not more than 1 mole % $O_2$.

The process of the present invention permits feeds containing more than 500 ppm nitrogen compounds to be processed easily, and even feeds containing 1000 or 1500 ppm N or more can now be cracked with reduced $NO_x$ emissions.

I claim:

1. In a process for the catalytic cracking of a heavy hydrocarbon feed containing nitrogen compounds by contact with a circulating inventory of catalytic cracking catalyst to produce catalytically cracked products and spent catalyst containing coke comprising nitrogen compounds, and wherein said spent catalyst is regenerated by contact with oxygen or an oxygen-containing gas in a catalyst regeneration zone operating at catalyst regeneration conditions to produce hot regenerated catalyst which is recycled to catalytically crack the heavy feed and said catalyst regeneration zone produces a flue gas comprising CO, $CO_2$ and oxides of nitrogen ($NO_x$), the improvement comprising reducing the $NO_x$ content of the flue gas by adding to the circulating catalyst inventory an additive comprising discrete particles comprising oxides of Group IIIB elements, exclusive of Group III elements which are ion exchanged or impregnated into said cracking catalyst, said additive being added in an amount sufficient to reduce the production of $NO_x$ relative to operation without said additive.

2. The process of claim 1 wherein the additive comprises oxides of lanthanum or yttrium or mixtures thereof.

3. The process of claim 1 wherein the additive particles comprise oxides of group IIIB metals deposited on a porous support, and wherein the cracking catalyst has a cracking activity and the additive has at least an order of magnitude less cracking activity than the cracking catalyst.

4. The process of claim 1 wherein the cracking catalyst comprises a matrix and the additive particles comprise oxides of group IIIB metals which are incorporated as discrete particles into the matrix of the cracking catalyst.

5. The process of claim 1 wherein the hydrocarbon feed contains more than 500 wt ppm nitrogen, $NO_x$ emissions in the flue gas are monitored, and wherein the amount of additive is adjusted at least periodically to reduce $NO_x$ emissions by at least 25%.

6. The process of claim 1 wherein the Group IIIB additive is lanthanum titanate.

7. The process of claim 1 wherein the additive comprises oxides of lanthanum or yttrium on a porous support comprising at least 10 wt % silica and said additive is essentially free of cerium.

8. In a process for the catalytic cracking of a hydrotreated, thermally treated, or distilled heavy hydrocarbon feed containing more than 500 ppm N and less than 1.0 wt ppm (Ni +V) and less than 0.5 wt % sulfur, on an elemental basis, by contact with a circulating inventory of catalytic cracking catalyst wherein said heavy feed is cracked by contact with a source of hot regenerated cracking catalyst to produce catalytically cracked products and spent catalyst containing coke comprising nitrogen compounds, and wherein said spent catalyst is regenerated by contact with oxygen or an oxygen-containing gas in a catalyst regeneration zone operating at catalyst regeneration conditions including the presence of excess oxygen or oxygen-containing gas to produce hot regenerated catalyst which is recycled to catalytically crack the heavy feed and said catalyst regeneration zone produces a flue gas comprising oxygen, CO, $CO_2$ and oxides of nitrogen ($NO_x$) the improvement comprising adding to the circulating catalyst inventory an additive comprising discrete particles comprising oxides of Group IIIB elements, exclusive of Group III elements which are ion exchanged or impregnated into said cracking catalyst, in an amount sufficient to reduce the production of $NO_x$ in said flue gas by at least 20%.

9. The process of claim 8 wherein the additive comprises oxides of lanthanum or yttrium or mixtures thereof.

10. The process of claim 8 wherein the additive is present in the form of separate particles which form a physical mixture with said cracking catalyst and said additive comprises oxides of group IIIB metals deposited on a porous support, and wherein the cracking catalyst has a cracking activity and the additive has at least an order of magnitude less cracking activity than the cracking catalyst.

11. The process of claim 8 wherein the cracking catalyst has a matrix and the additive particles comprise oxides of group IIIB metals which are incorporated as discrete particles into the matrix of the cracking catalyst.

12. The process of claim 8 wherein the Group IIIB additive is lanthanum titanate.

13. The process of claim 8 wherein the additive comprises oxides of lanthanum or yttrium on a porous support comprising at least 10 wt % silica and said additive is essentially free of cerium.

14. The process of claim 8 wherein the additive is oxides of lanthanum or lanthanum titanate on separate particles, the additive particles comprise 0.1 to 20 wt % of the circulating catalyst inventory and the particles contain 1 to 20 wt % lanthanum on an elemental metal basis.

15. The process of claim 8 wherein $NO_x$ emissions in the flue gas are reduced by at least 25%

16. The process of claim 8 wherein the heavy feed contains less than 0.3 wt % sulfur and wherein 0.2 to 10 wt. % additive comprising 2 to 15 wt % lanthanum, on an elemental metal basis, is added to the catalyst inventory in the form of separate particles and wherein $NO_x$ emissions are reduced at least 33% relative to operation at the same regenerator conditions without lanthanum addition.

17. The process of claim 16 wherein the heavy feed contains more than 1000 wt ppm nitrogen.

18. The process of claim 8 wherein the additive comprises lanthanum oxide or lanthanum titanate on a support of silica, alumina, silica-alumina or mixtures thereof.

19. The process of claim 8 wherein the regenerator flue gas contains no more than 1 mole % oxygen.

20. A process for the catalytic cracking of a heavy hydrocarbon feed comprising more than 1000 wt ppm nitrogen by contacting the heavy feed with a circulating inventory of cracking catalyst comprising a zeolite containing cracking catalyst which catalyst inventory comprises 0.1 to 10 wt ppm Pt or other CO combustion promoting metal having an equivalent combustion activity said process comprising:

cracking the heavy feed with said circulating inventory of catalytic cracking catalyst which contains from 0.5 to 5 wt % or an oxide of lanthanum, yttrium, or mixtures thereof or lanthanum titanate, on an elemental metal basis, exclusive of lanthanum or yttrium which are ion exchanged or impregnated into said cracking catalyst, in a catalytic cracking reaction zone means to produce cracked products and spent catalyst containing nitrogenous coke;

separating and recovering from spent catalyst catalytically cracked products as a product of the process and a spent catalyst stream containing strippable cracked products;

stripping the spent catalyst to remove strippable cracked products therefrom and produce stripped catalyst containing nitrogenous coke;

regenerating the stripped catalyst by contact with an excess supply of oxygen or an oxygen-containing gas in a catalyst regeneration means to produce regenerated catalyst which is recycled to the catalytic cracking zone means to crack fresh feed and a flue gas containing CO, $CO_2$, $O_2$, $NO_x$, and wherein at least 90% of the CO is converted to $CO_2$, and at least 25% of the $NO_x$ is catalytically converted in the regeneration zones means to nitrogen by said oxide of lanthanum, yttrium, or mixtures thereof or lanthanum titanate.

* * * * *